US007059473B2

(12) United States Patent
Watanabe et al.

(10) Patent No.: US 7,059,473 B2
(45) Date of Patent: Jun. 13, 2006

(54) PACKAGING METHOD OF PLASMA DISPLAY PANEL MODULES

(75) Inventors: Hiroshi Watanabe, Kyoto (JP); Hidenori Tougo, Nara (JP); Shozo Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 625 days.

(21) Appl. No.: 10/116,747

(22) Filed: Apr. 5, 2002

(65) Prior Publication Data

US 2002/0159240 A1 Oct. 31, 2002

(30) Foreign Application Priority Data

| | | |
|---|---|---|
| Apr. 5, 2001 | (JP) | 2001-106736 |
| Apr. 5, 2001 | (JP) | 2001-106737 |
| Apr. 5, 2001 | (JP) | 2001-106738 |
| Apr. 5, 2001 | (JP) | 2001-106739 |
| Apr. 5, 2001 | (JP) | 2001-106740 |
| Apr. 5, 2001 | (JP) | 2001-106741 |

(51) Int. Cl.
*B65D 85/48* (2006.01)

(52) U.S. Cl. ..... 206/454; 206/453; 206/521; 206/586

(58) Field of Classification Search ..... 206/454, 206/521, 523, 586–592, 305, 320, 453; 445/24–25
See application file for complete search history.

(56) References Cited

U.S. PATENT DOCUMENTS

| | | | | |
|---|---|---|---|---|
| 4,333,565 A | | 6/1982 | Woods | |
| 5,002,184 A | * | 3/1991 | Lloyd | 206/305 |
| 5,465,838 A | * | 11/1995 | Hollander et al. | 206/305 |
| 5,584,401 A | | 12/1996 | Yoshida | |
| 5,779,055 A | * | 7/1998 | Lacy, III | 206/521 |
| 6,050,417 A | * | 4/2000 | Smith | 206/521 |
| 6,158,590 A | | 12/2000 | Fujikawa et al. | |
| 6,247,986 B1 | * | 6/2001 | Chiu et al. | 445/24 |
| 6,369,501 B1 | * | 4/2002 | Aoki et al. | 445/24 |
| 6,450,850 B1 | * | 9/2002 | Nunomura | 445/24 |

FOREIGN PATENT DOCUMENTS

| | | |
|---|---|---|
| EP | 0639505 A1 | 2/1995 |
| JP | 7-326889 | 12/1995 |
| JP | 10-194344 | 7/1998 |
| JP | 11-59773 | 3/1999 |
| JP | 11-130143 | 5/1999 |
| JP | 2000-85847 | 3/2000 |

* cited by examiner

*Primary Examiner*—Bryon P. Gehman
(74) *Attorney, Agent, or Firm*—McDermott Will & Emery LLP

(57) ABSTRACT

A panel module includes a panel in which a pair of substrates at least having a transparent front substrate is disposed facing each other with a discharge space in between and electrodes are disposed on substrates; a chassis for holding this panel; and a display driving circuit for applying a signal to the panel attached to the chassis for display. A resin front protective cover having substantially the same dimensions as a front frame of a finished plasma display device is provided on a periphery of the panel module for protecting the periphery of the panel module.

23 Claims, 17 Drawing Sheets

PACKAGING METHOD OF PLASMA DISPLAY PANEL MODULES

FIELD OF THE INVENTION

The present invention relates to packaging methods of plasma display panel modules (hereinafter called panel modules) which are known for thin, lightweight display devices with a large screen.

BACKGROUND OF THE INVENTION

Due to their good viewability, plasma display devices are increasingly being adopted as promising display panels (thin display devices). Further developments to achieve high definition and larger screens are in progress.

Plasma display devices can be roughly divided into two types: AC and DC driven types. With respect to discharge type, there are plane discharge and opposed discharge types. Currently, AC type plane discharge plasma display devices are the most commonly used because of their potential for high definition, larger screen size, and ease of production.

These AC type plane discharge plasma display devices are manufactured using the following process. First, a pair of transparent glass substrates are disposed facing each other to create a space for discharge in between, and electrodes are disposed on these glass substrates. Once assembled, these glass substrates are called a plasma display panel (hereinafter referred to as a "panel"). A panel module includes a chassis holding this panel and a display driving circuit block, attached to the chassis, that applies signals to the panel for display. A finished plasma display device refers to this panel module covered with a casing.

The above plasma display device can be manufactured in larger screen sizes more easily than other display devices such as liquid crystal displays and CRTs. In addition, it can achieve a sharper image than other large display devices. Accordingly, plasma display devices are increasingly being used as information display screens installed in locations where large audiences can view them, and for enjoying dynamic video images at home.

However, plasma display devices, although easy to manufacture in large-screen form, require large glass substrates, which are the major components of the panel. In addition, they generate a significant amount of heat during use because images are displayed by means of plasma discharge at selected cells. Accordingly, plasma display devices need countermeasures which were then not necessary in other display devices.

The manufacture of panels requires large-scale facilities. Accordingly, most display manufacturers recently purchase panel modules from panel manufacturers and attach other circuit blocks. They are then set in the casing to complete finished plasma display devices.

In this case, another countermeasure is needed to prevent panels from being damaged by impact during transportation of panel modules.

SUMMARY OF THE INVENTION

An object of the present invention is to solve the above disadvantage by preventing damage to panel modules during transportation.

To achieve this object, a packaging method of the present invention includes a panel module configured as follows. A pair of substrates with at least the front substrate transparent are disposed facing each other to create a discharge space in between, and electrodes are disposed on the substrates to configure a panel. The panel module is configured with a chassis which holds the panel and a display driving circuit block attached to the chassis for displaying images by applying signals to the panel. The packaging method of the present invention provides a resin front protective cover, which has substantially the same dimensions as a front frame of the finished plasma display device, to the periphery of the panel module to protect the periphery of the panel module.

Another packaging method of the present invention includes the panel module configured as follows. A pair of substrates with at least the front substrate transparent are disposed facing each other to create a discharge space in between, and electrodes are disposed on the substrates to configure the panel. The panel module is configured with a chassis which holds the panel and a display driving circuit block which is attached to the chassis for displaying images by applying signals to the panel. The packaging method of the present invention provides the resin front protective cover, which has substantially the same dimensions as the front frame of the finished plasma display device, to the periphery where a flexible wiring board is disposed for connecting the panel of the panel module and the display driving circuit block. A cushioning material containing an antistatic agent is applied to the inner face of the front protective cover at the position contacting the flexible wiring board.

As described above, the packaging method of the plasma display panel module of the present invention provides the resin front protective cover having substantially the same dimensions as the front frame of the finished plasma display device to protect the periphery of the panel module. Accordingly, damage to the panel module during transportation is preventable.

DETAILED DESCRIPTION OF PREFERRED EMBODIMENT

A plasma display device in an exemplary embodiment of the present invention is described with reference to FIGS. 1 to 7.

Figure 1:
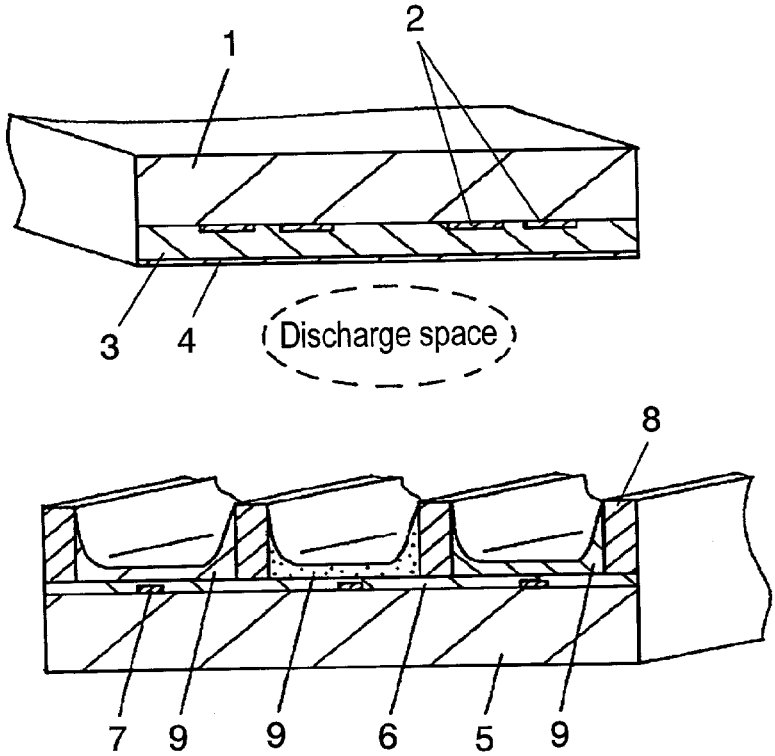
FIG. 1 is a perspective view of an example of a brief panel structure of a plasma display device.

FIG. 1 shows a panel structure of the plasma display device. As shown in FIG. 1, striped display electrodes 2 comprising a pair of scan electrode and a sustain electrode are aligned in two or more lines on transparent substrate 1, made typically of glass, on the front side. Dielectric layer 3 is formed to cover these electrodes 2. Protection film 4 is formed on dielectric layer 3.

Striped address electrodes 7 covered with overcoat layer 6 are aligned in two or more lines on substrate 5 at the rear side which is disposed opposing substrate 1 at the front side. Address electrodes 7 are disposed so as to cross display electrodes 2 of scan electrodes and sustain electrodes. Walls 8 are disposed parallel to address electrodes 7 on overcoat layer 6 between address electrodes 7, and phosphor layer 9 is applied to the side faces of these walls 8 and the surface of overcoat layer 6.

These substrates 1 and 5 are disposed facing each other such that display electrodes 2 of scan electrodes and sustain electrodes, and address electrodes 7 cross perpendicularly with a very thin discharge space between them. The periphery of these substrates 1 and 5 is sealed, and pure or mixed helium, neon, argon and/or xenon gas is injected into the discharge space to serve as discharge gas. The discharge space is partitioned into blocks by walls 8 so that numerous discharge cells, in which display electrode 2 and the address electrode cross, are provided. Red, green, and blue phosphor layers 9 are sequentially disposed in each discharge cell.

Figure 2:
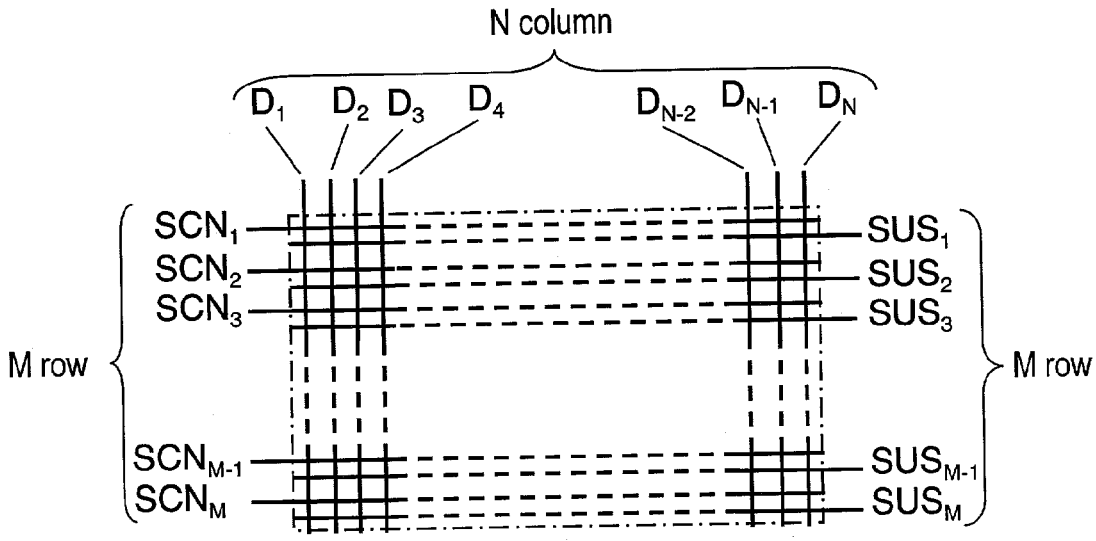
FIG. 2 is a wiring diagram of an example of an electrode alignment in the panel.

FIG. 2 shows the electrode alignment of the plasma display panel. As shown in FIG. 2, the scan electrode and sustain electrode are aligned with the address electrode in an M×N matrix. In the row direction are aligned M rows of scan electrodes SCN1 to SCNM and sustain electrodes SUS1 to SUSM. In the column direction are aligned N columns of address electrodes D1 to DN.

In the plasma display panel in which electrodes are configured as above, address discharge occurs between the address electrode and scan electrode by applying a write pulse between the address electrode and scan electrode. Then, after selecting the discharge cell, the discharge is sustained between the scan electrode and sustain electrode by applying a periodic sustaining pulse which alternates between the scan electrode and sustain electrode to display the required image.

Figure 3:
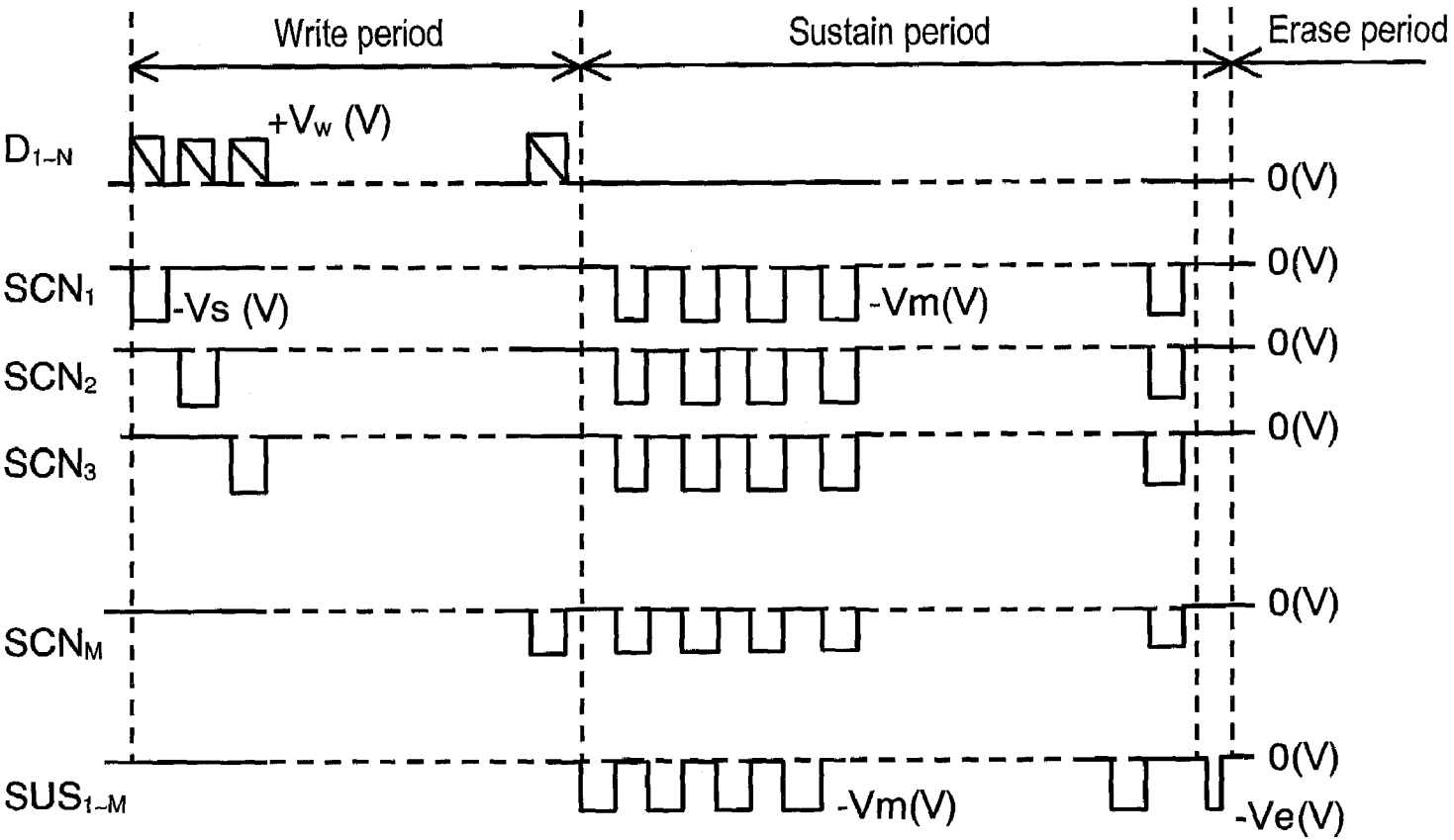
FIG. 3 is an example of a signal waveform for driving the display of the panel.

FIG. 3 shows a timing chart of the display driving circuit of the plasma display device. Write discharge occurs at the cross point of the predetermined address electrode D1 to DN and scan electrode SCN1 in the first row by applying a positive write pulse voltage $+V_w$ (V) to the predetermined address electrode D1 to DN corresponding to the discharge cell in the first row, and applying a negative scan pulse voltage $-V_s$ (V) to scan electrode SCN1 in the first row, after holding all sustain electrodes SUS1 to SUSM at 0 (V).

Next, write discharge occurs at the cross point of a predetermined address electrode D1 to DN and scan electrode SCN2 in the second row as a result of applying a positive write pulse voltage $+V_w$ (V) to the predetermined address electrode D1 to DN corresponding to the discharge cell in the second row, and applying a negative scan pulse voltage $-V_s$ (V) to scan electrode SCN2 in the second row.

The same operation as described above is executed sequentially. Lastly, write discharge occurs at the cross point of a predetermined address electrode D1 to DN and scan electrode SCNM in row M by applying a positive write pulse voltage $+V_w$ (V) to the predetermined address electrode D1 to DN corresponding to the discharge cell in the M row and applying a negative scan pulse voltage $-V_s$ (V) to scan electrode SCNM in M row.

In the next sustain period, all scan electrodes SCN1 to SCNM are simultaneously sustained at 0 (V), and negative sustain pulse voltage $-V_m$ (V) is applied to all sustain electrodes SUS1 to SUSM. This generates a sustain discharge between scan electrodes SCN1 to SCNM and sustain electrodes SUS1 to SUSM at the cross points where write discharge has occurred. Then, negative sustain pulse voltage $-V_m$ (V) is alternately applied between all scan electrodes SCN1 to SCNM and all sustain electrodes SUS1 to SUSM to maintain sustain discharge in the discharge cells to be displayed. Images are displayed on the panel as a result of emission of this sustain discharge.

In the next erase period, all scan electrodes SCN1 to SCNM are simultaneously sustained at 0 (V); then erase pulse voltage $-V_e$ (V) is applied to all sustain electrodes SUS1 to SUSM to generate erase discharge for stopping discharge.

The above operation enables the display of information of one screen on the plasma display device.

Figure 4:
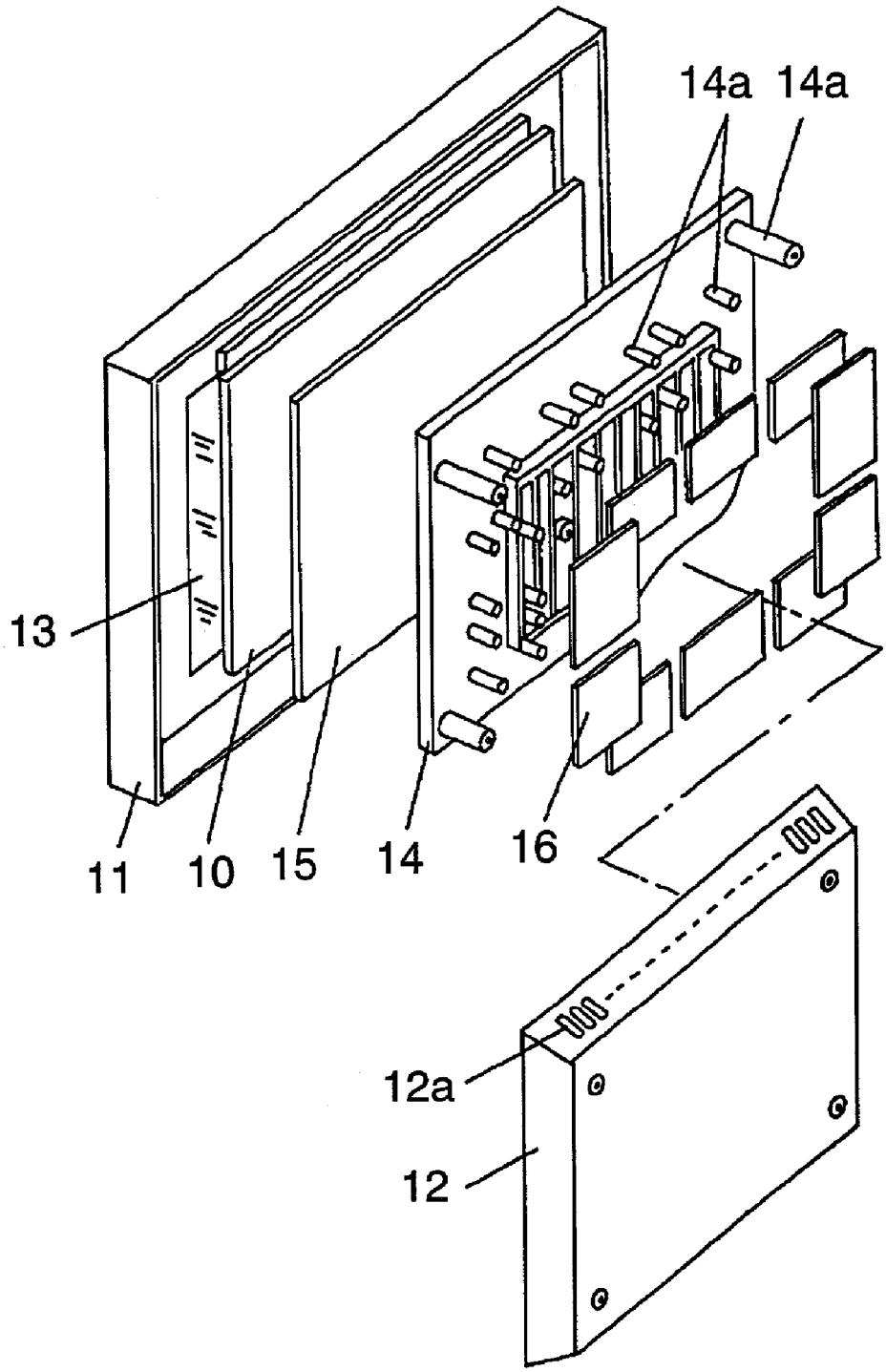
FIG. 4 is an exploded perspective view of an example of an overall structure of the plasma display device.

FIG. 4 shows the overall structure of the plasma display device into which the panel with the structure described above is assembled. The casing which stores panel 10 includes front frame 11 and metal back cover 12. Front cover 13, made of glass, is disposed on an opening of front frame 11 to cover and protect the optical filter and panel 10. Typically, silver is deposited on this front cover 13 to suppress unwanted irradiation by electromagnetic waves.

Furthermore, several cooling vents 12*a* are provided on back cover 12 to allow heat generated in panel 10 to escape.

Panel 10 is adhered onto the front of chassis 14, typically made of aluminum, via heat-conducting sheet 15. Several circuit blocks 16 are attached to the rear face of chassis 14 for driving panel 10 for display. Heat-conducting sheet 15 efficiently transfers heat generated in panel 10 to chassis 14 for heat dissipation. Circuit blocks 16 contain an electric circuit for driving and controlling the display on panel 10, and are electrically connected to an electrode leader drawn to the edge of panel 10 using several flexible wiring boards (not illustrated) extending beyond the four edges of chassis 14.

Boss 14*a* is provided protruding from chassis 14 at the rear face, typically by integral die-casting for attaching circuit block 16 or securing back cover 12. Chassis 14 may also be configured with a fixing pin on a flat aluminum sheet.

Figure 5:
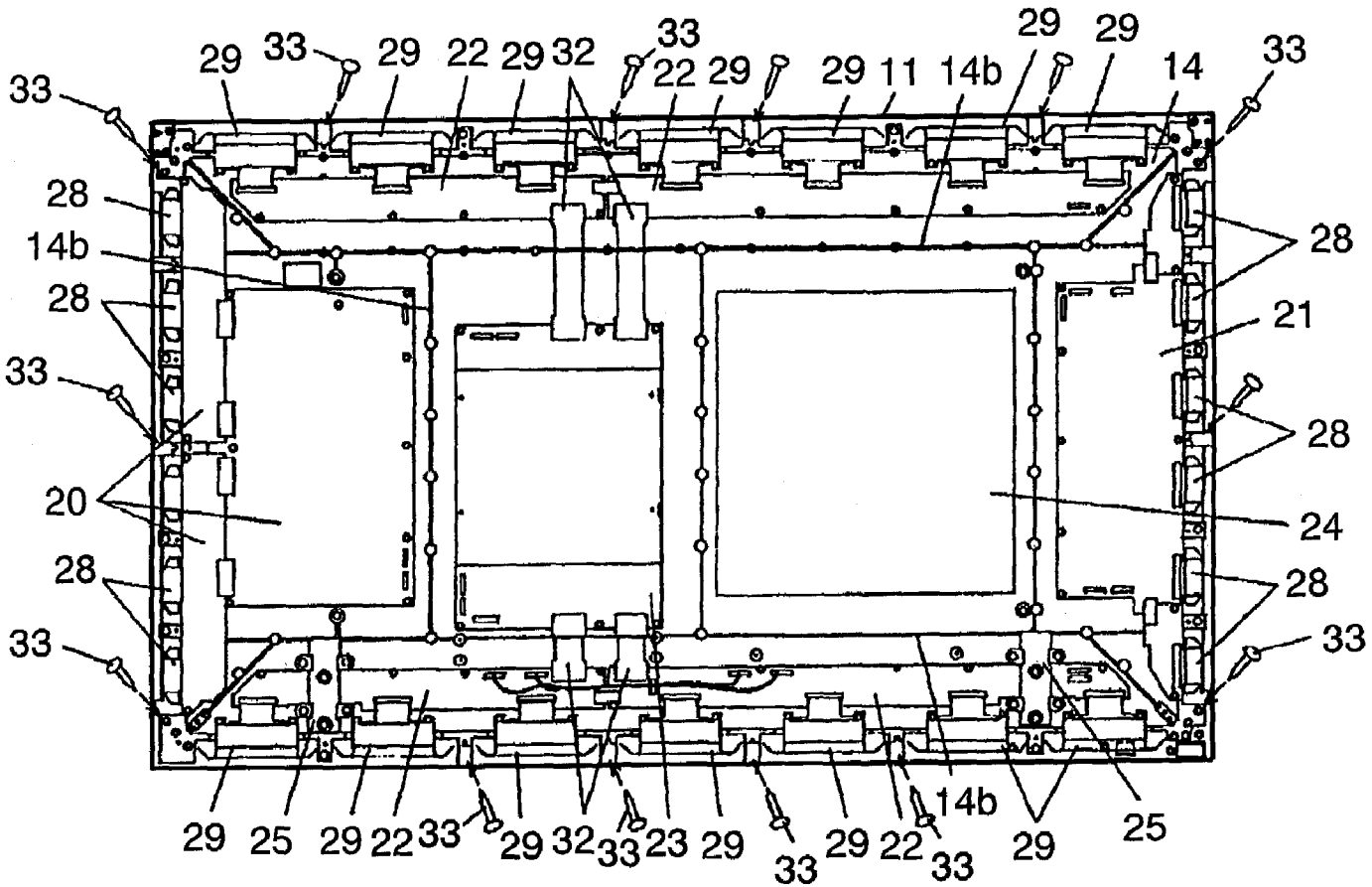
FIG. 5 is a plan view of an example of a layout seen from the side of the display driving circuit block inside the plasma display device.

FIG. 5 is a plan view illustrating the internal layout of the plasma display device as configured above when back cover 12 is detached. Scan driver circuit block 20 supplies a predetermined signal voltage to the scan electrode on panel 10. Sustain driver circuit block 21 supplies a predetermined signal voltage to the sustain electrode on panel 10. Address driver circuit block 22 supplies a predetermined signal voltage to the address electrode on panel 10. Scan driver circuit block 20 and sustain driver circuit block 21 are disposed respectively to both edges in the width direction of chassis 14. Address driver circuit block 22 is disposed at the top and bottom edges in the height direction of chassis 14.

Control circuit block 23, disposed approximately at the center of chassis 14, converts video data to video data signal corresponding to the number of pixels on panel 10 based on video signals from the input circuit, and supplies it to address driver circuit block 22. In addition, control circuit block 23 generates a discharge control timing signal, and supplies it to scan driver circuit block 20 and sustain driver circuit block 21 for controlling driving for display including grayscale control. Power supply block 24 supplies voltage to each of the aforementioned circuit blocks, and is disposed substantially at the center of chassis 14, same as control circuit block 23.

Wall 14*b* is provided on chassis 14 for partitioning each circuit block.

Figure 6:
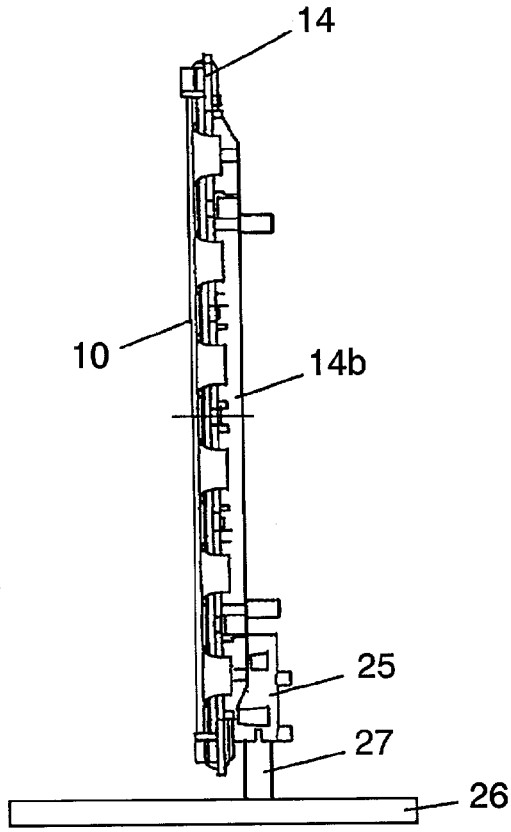
FIG. 6 is a plan view seen from the side of the panel module.

Bracket 25 is for mounting the panel onto a stand pole 27, and is provided at the bottom in the height direction of chassis 14. FIG. 6 shows the panel attached to the stand 26 without front frame 11 present. The top part of stand pole 27 attached to stand 26 is inserted into a hole on bracket 25 and stand pole 27 is secured onto bracket 25, typically by a screw. This holds the panel upright.

Figure 7:
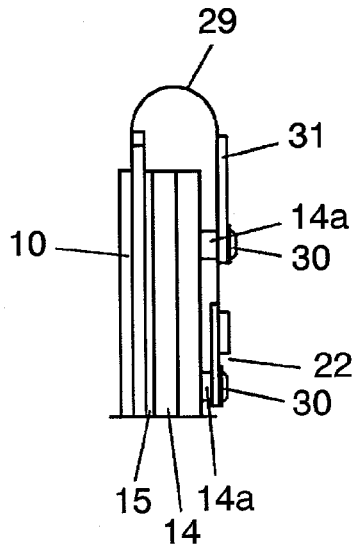
FIG. 7 is a magnified view illustrating a key structure of the panel module.

Flexible wiring board 28 connects the electrode leader of the scan electrode and sustain electrode on panel 10, and scan driver circuit block 20; and sustain driver circuit block 21 and a printed circuit board. Flexible wiring board 29 connects the electrode leader of the address electrode on panel 10 and the printed wiring board of address driver circuit block 22. As shown in FIG. 7, flexible wiring board 29 is disposed along the periphery of panel 10 and routed from the front face to the rear face by bending 180 degree.

In the exemplary embodiment, as shown in FIG. 7, one end of flexible wiring board 29 connected to the electrode leader of the address electrode on panel 10 is connected to data relay board 31 attached to boss 14*a* of chassis 14 by screw 30. This data relay board 31 is connected to the attached printed wiring board of address driver circuit block 22 and ground to boss 14*a* on chassis 14 by screw 30. Each of circuit blocks is connected by flexible wiring board 32 and wiring lead (not illustrated) disposed through an opening provided on wall 14*b*.

Front frame 11 is secured onto chassis 14 by screw 33, as shown in FIG. 5.

The present invention prevents damage to the panel module by shocks experienced during transportation when the panel module as configured above in the plasma display device is shipped. Exemplary embodiments of the present invention are detailed below with reference to FIGS. 8 to 15.

Figure 8:
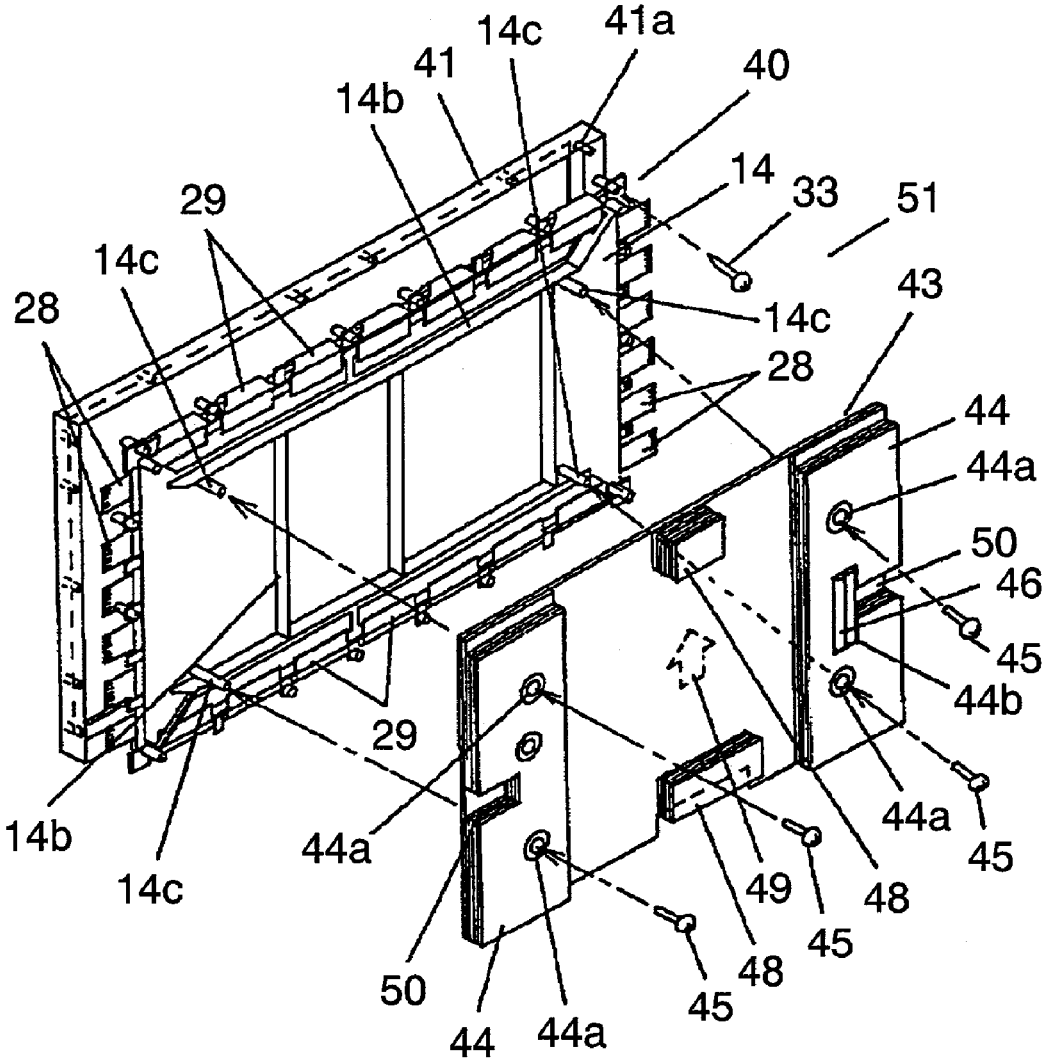
FIG. 8 is a perspective view illustrating a packaging method of a plasma display panel module in accordance with an exemplary embodiment of the present invention.
Figure 9:
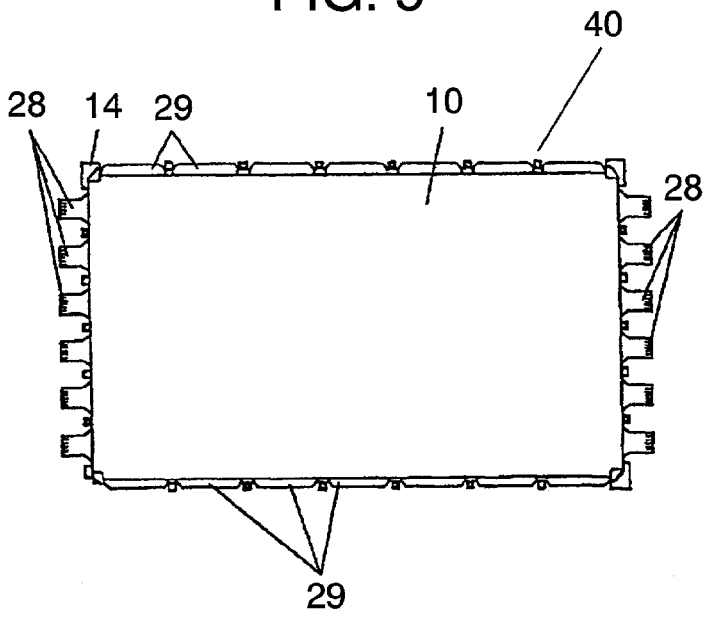
FIG. 9 is a plan view of the plasma display panel module seen from the panel side in accordance with the exemplary embodiment of the packaging method of the present invention.

FIG. 8 shows a packaging method of the panel module in the exemplary embodiment of the present invention. Panel module 40 includes aforementioned panel 10, chassis 14 to which panel 10 is attached, and display driving circuit block, described in FIG. 5, attached to chassis 14 for applying a signal to the display panel for display. FIG. 9 is a plan view of this panel module 40 seen from the panel 10 side.

The exemplary embodiment shown in FIG. 8 shows the case where the panel module includes a part of the address driver circuit block 22 in the display driving circuit blocks. However, this is determined based on the market for which the panel module is designed. In other cases, the panel module may include all circuit blocks related to the display driving circuit shown in FIG. 5. In still other cases, the panel module may only include simple connections of electrode leaders of the scan electrode, sustain electrode, and address electrode on panel 10 to flexible wiring boards 28 and 29 of the display device circuit blocks.

Figure 10:
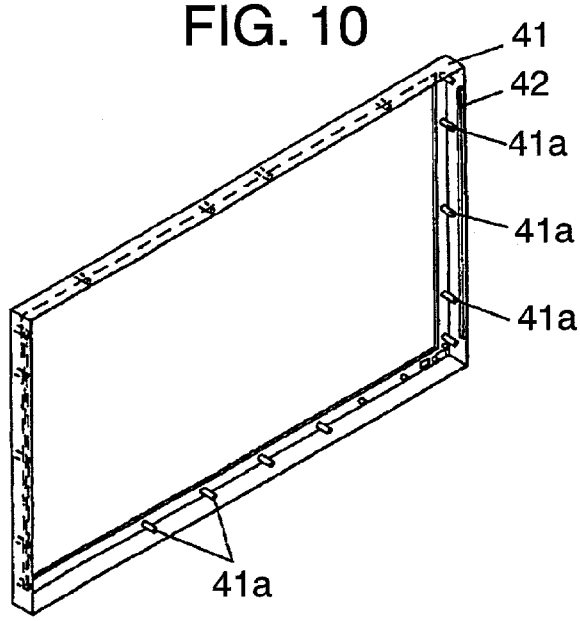
FIG. 10 is a perspective view of a front protective cover in accordance with the exemplary embodiment of the packaging method of the present invention.
Figure 11:
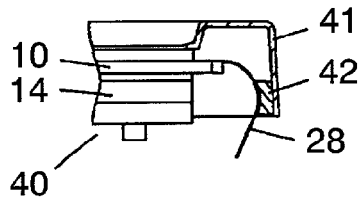
FIG. 11 is a magnified view of a key structure illustrating the state when the front protective cover shown in FIG. 10 is applied to the plasma display panel module.

Front protective cover 41 is made by molding polyethylene terephthalate (PET) resin into substantially the same dimensions as front frame 11. This front protective cover 41 has a basically L-shape section face, and is applied to cover the periphery where flexible wiring boards 28 and 29 for connecting panel 10 of panel module 40 and the display driving circuit block are disposed. As shown in FIG. 10, two or more screwing sections 41*a* are integrally provided on the periphery of this front protective cover 41, and screw 33 is used for screwing and fixing front protective cover 41 to chassis 14 of panel module 40 at these screwing sections 41*a*.

On the inner face of front protective cover 41 corresponding to flexible wiring board 28, cushioning material 42, typically made of spongy rubber containing an antistatic agent, is disposed. Flexible wiring boards 28 originally protruding to both sides, as shown in FIG. 9, are bent substantially in a U shape to the rear face of panel module 40. The top part of this bent flexible wiring board 28 contacts the cushioning material 42 so as to prevent uncovered connecting terminal at the tip of flexible wiring board 28 from contacting front protective cover 41. In addition, buildup of electrostatic charge in the flexible wiring board 28 is preventable by using cushioning material 42 containing an antistatic agent.

Rear protective cover 43 is made of corrugated cardboard and has substantially the same dimensions as the back cover of the finished plasma display device. At both ends in the width direction of this rear protective cover 43 made of corrugated cardboard, reinforcement 44, made by stacking several corrugated cardboard sheets, is provided. There are four holes 44*a* provided on this reinforcement 44. Four bosses 14*c* integrally provided on chassis 14, to which metal fittings for attaching the plasma display device to the wall will be screwed, are inserted into these holes 44*a*. Reinforcement 44 is fixed to chassis 14 using screw 45 for anchoring the metal fitting.

Figure 12:
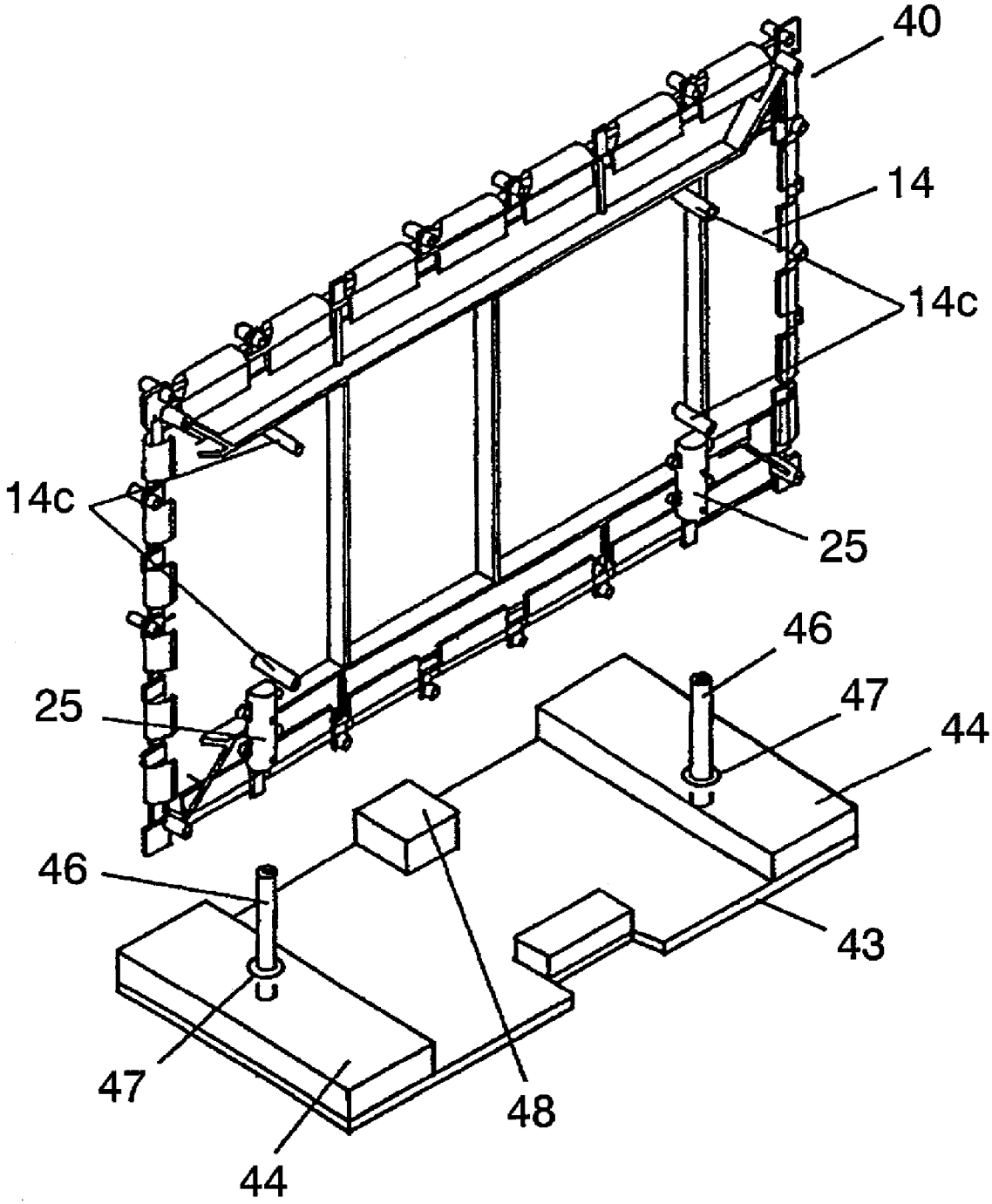
FIG. 12 is a perspective view illustrating a key structure in accordance with the exemplary embodiment of the packaging method of the present invention.

In addition, notch 44*b* is provided on reinforcement 44 at one side of rear protective cover 43, and two stand poles 46 made of aluminum, resin, and paper tubing are detachably set in this notch 44*b*. In addition, as shown in FIG. 12, hole 47 for mounting stand pole 46 at an interval of two brackets 25 on panel module 40 is provided on reinforcement 44 of rear protective cover 43. When the purchaser receiving panel module 40 detaches rear protective cover 43 from panel module 40, rear protective cover 43 may be used instead of stand 26 shown in FIG. 6 for mounting stand pole 46 to rear protective cover 43. Bracket 25 of panel module 40 is set to this stand pole 46 for holding panel module 40 upright.

More specifically, there is a difficulty in installing panel module 40 except for the cases that casing and stand are not required, such as when the plasma display device is set into a wall for business use. In the present invention, installation work is facilitated because panel module 40 can be kept upright using rear protective cover 43 as a stand by inserting stand pole 46 into rear protective cover 43 as described above.

Hole 44*a* on reinforcement 44 shown in FIG. 8 for attaching rear protective cover 43 may also be used as hole 47, as shown in FIG. 12, for mounting stand pole member 46 by providing the same distance between bosses 14*c* and brackets 25 respectively on chassis 14 of panel module 40.

Moreover, thickened portion 48, made by stacking several corrugated cardboard sheets, same as reinforcement 44, is provided at the top and bottom at the center part of rear protective cover 43. This increases the cushioning effect for suppressing the bouncing pressure applied to the panel center if panel module 40 is accidentally tipped over or dropped during transportation.

Furthermore, direction arrow mark 49 is placed at approximately the center of the rear protective cover to identify the top and bottom of panel module 40, and catch 50 for carrying panel module 40 is made by cutting a part of this reinforcement 44 at both ends of reinforcement 44 in the width direction.

Accordingly, packed module 51 is configured by attaching front protective cover 41 and rear protective cover 43 to panel module 40.

Figure 13:
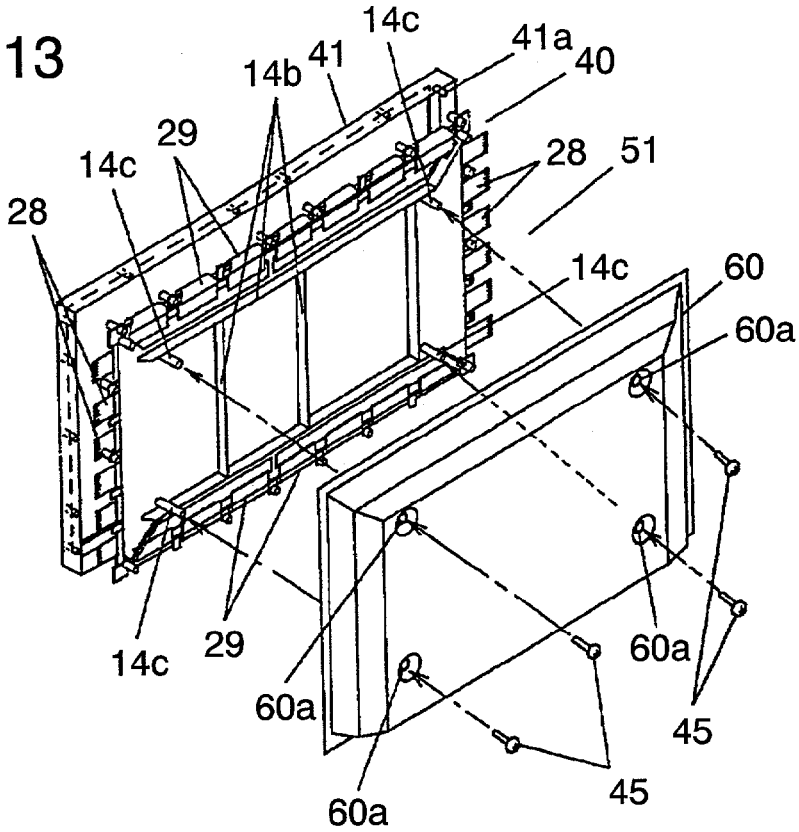
FIG. 13 is a perspective view illustrating a packaging method of a plasma display panel module in another exemplary embodiment of the present invention.
Figure 14:
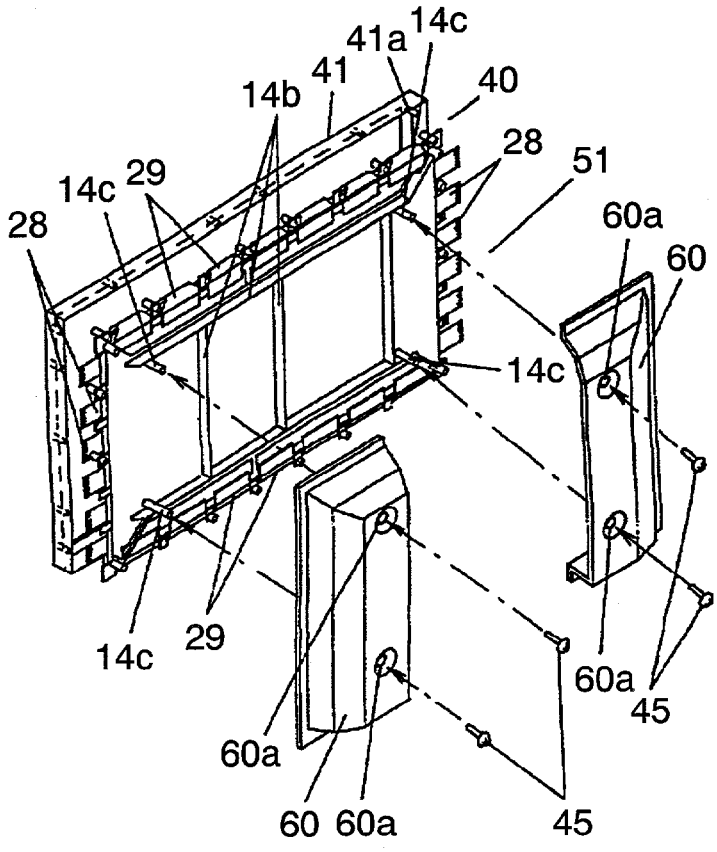
FIG. 14 is a perspective view illustrating the packaging method of the plasma display panel module in still another exemplary embodiment of the present invention.
Figure 15:
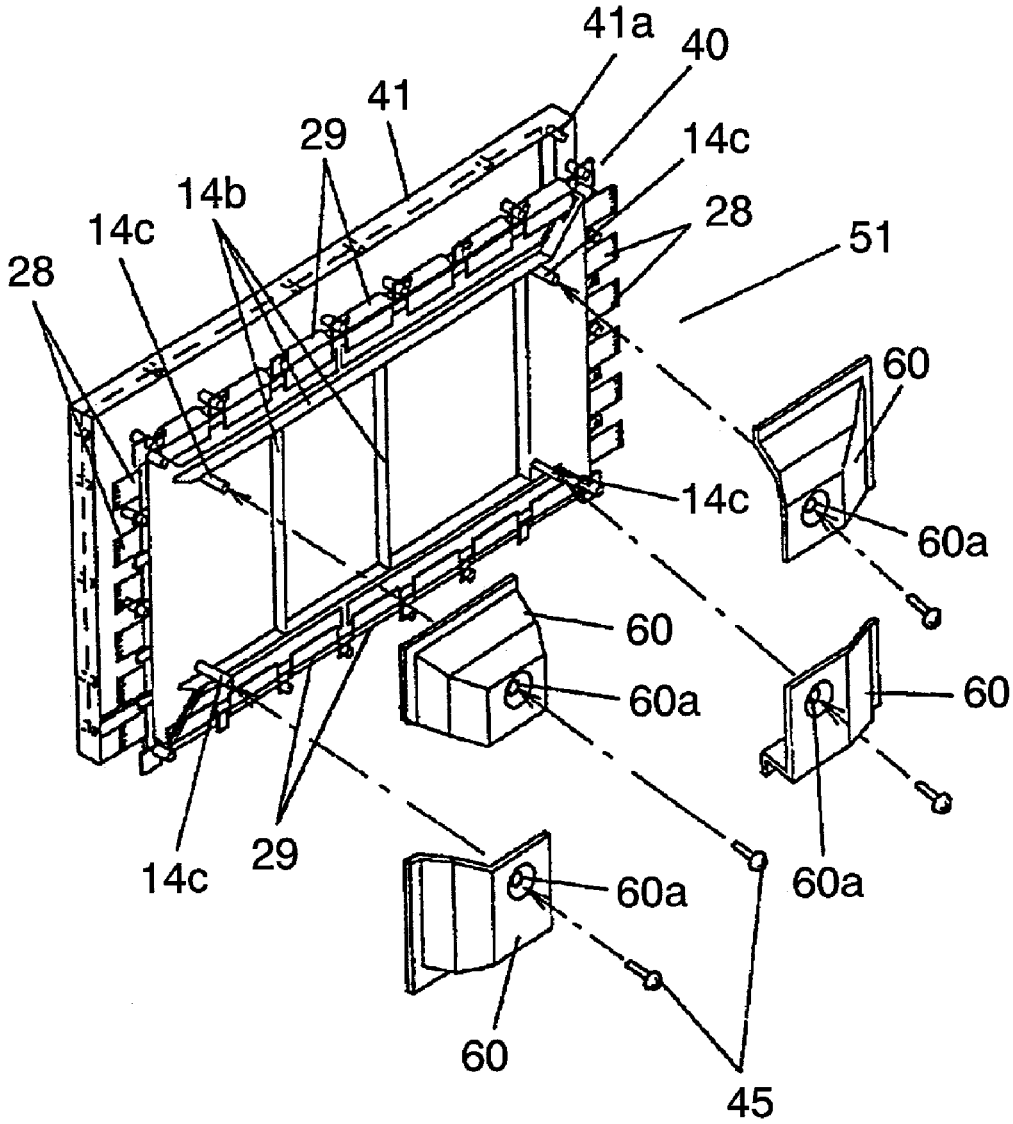
FIG. 15 is a perspective view illustrating a packaging method in a plasma display panel module in yet another exemplary embodiment of the present invention.

FIGS. 13 to 15 show rear protective covers in packed module 51 in the panel module packaging method in other exemplary embodiments of the present invention. These exemplary embodiments are described below.

The exemplary embodiment shown in FIG. 13 employs rear protective cover 60 made of PET resin which has substantially the same dimensions as back cover 12. There are four holes 60*a* provided on this rear protective cover 60, and four bosses 14*c* integrally provided on chassis 14, to which metal fittings for attaching the plasma display device to the wall will be screwed, are inserted into these holes 60*a*. Rear protective cover 60 is fixed to chassis 14 using screw 45 for anchoring the metal fitting.

Still another exemplary embodiment shown in FIG. 14 has rear protective cover 60 made of PET resin which has substantially the same dimensions as the side face in the width direction of back cover 12. In this exemplary embodiment, only both sides of the rear face of panel module 40 are covered. There are four holes 60*a* provided on this rear protective cover 60, and four bosses 14*c* integrally provided on chassis 14, to which metal fittings for attaching the plasma display device to the wall will be screwed, are inserted into these holes 60*a*. Rear protective cover 60 is fixed to chassis 14 using screw 45 for anchoring the metal fitting.

Yet another exemplary embodiment shown in FIG. 15 has a rear protective cover 60 made of PET resin which has substantially the same dimensions as the four corners of back cover 12. In this exemplary embodiment, only the four corners of panel module 40 are covered. There are four holes 60*a* provided on this rear protective cover 60, and four bosses 14*c* integrally provided on chassis 14, to which metal fittings for attaching the plasma display device to the wall will be screwed, are inserted into these holes 60*a*. Rear protective cover 60 is fixed to chassis 14 using screw 45 for anchoring the metal fitting.

In other words, the exemplary embodiments shown in FIGS. 13 to 15 employ rear protective cover 60 for packed module 51, in which front protective cover 41 and rear protective cover 43 are attached to panel module 40, and this rear protective cover 60 has substantially the same dimensions as at least the corners of finished back cover 12 of the plasma display device. In addition, rear protective cover 60 is made of PET resin which can be recycled from PET bottles and containers. This enables rear protective cover 60 to be recycled after detaching front protective cover 41 and rear protective cover 60 from panel module 40 after opening the packaging box. In addition, since both protective covers have substantially the same dimensions as the outer dimensions of the finished plasma display device, the panel module may be packed using the packaging box for the finished plasma display device.

Furthermore, in the exemplary embodiment shown in FIG. 15, rear protective cover 60 covers only the four corners of panel module 40, and thus rear protective cover 60 can be used for all models, regardless of panel screen size.

Figure 16:
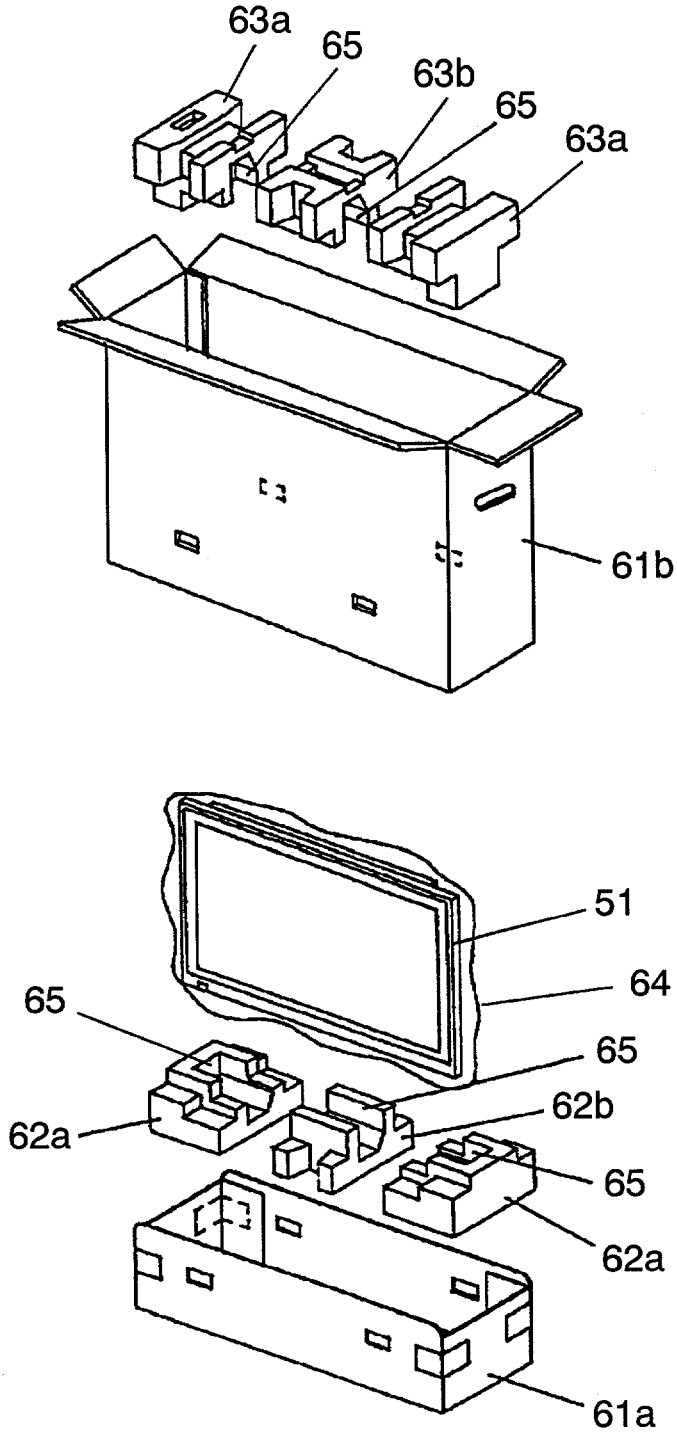
FIG. 16 is a perspective view illustrating the state of packaging the plasma display panel module in a packaging box in accordance with the exemplary embodiment of the present invention.

FIG. 16 shows the state of packaging packed module 51 in which panel module 40 is protected with front protective cover 41 and rear protective cover 43 in the packaging box. The packaging box is the same as that for packaging the finished plasma display device.

A rectangular parallelepiped-shaped packaging box is configured with bottom box 61*a* with short height dimension and top box 61*b* with long height dimension. Top box 61*b* covers bottom box 61*a*. Cushioning materials 62*a*, 62*b*,. 63*a*, and 63*b* are respectively disposed on the bottom inner face of bottom box 61*a* and the top inner face of top box 61*b*. Packed module 51 covered with sheet 64 is held with these cushioning materials 62*a*, 62*b*, 63*a*, and 63*b*, and stored in the packaging box.

Cushioning material 62*a* is disposed at the corner of bottom box 61*a*, and cushioning material 62*b* is disposed at approximately the center of bottom box 61*a*. Groove 65 is provided on both cushioning materials 62*a* and 62*b* for respectively fitting reinforcement 44 and thickened portion 48 of rear protective cover 43 shown in FIG. 8. In addition, cushioning material 63*a* is disposed at a corner of top box 61*b*. Cushioning material 63*b* is disposed at approximately the center of top box 61*b*. As with cushioning materials 62*a* and 62*b*, groove 65 is provided on cushioning materials 63*a* and 63*b* for respectively fitting reinforcement 44 and thickened portion of rear protective cover 43.

In other words, the packaging method of the exemplary embodiments of the present invention applies resin front protective cover 41 to the periphery of the front face of panel module 40 and applies rear protective cover 43 to the rear face of panel module 40 where the display driving circuit is disposed. This permits the use of protective covers of substantially the same size as the outer dimensions of the finished plasma display device. Accordingly, panel module 40 may be packaged using a regular packaging box used for the finished plasma display device, eliminating the need to make a new packaging box specifically designed for the panel module.

Moreover, front protective cover 41 for protecting panel module 41 is made of PET resin which is typically produced by recycling PET bottles, and rear protective cover 43 is made of corrugated cardboard. Accordingly, front protective cover 41 and rear protective cover 43, after being removed from panel module 40, are recyclable as resources, achieving environmentally-friendly packaging.

Figure 17:
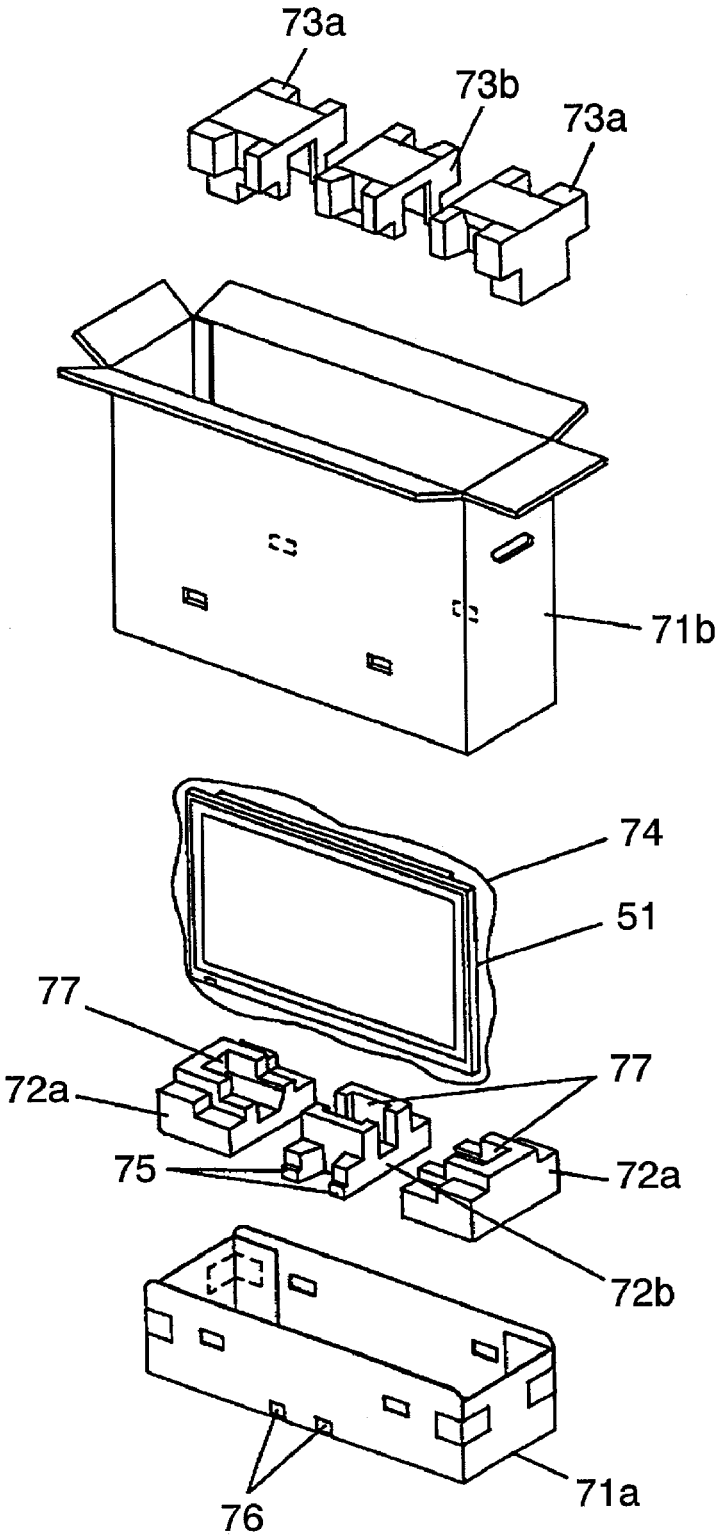
FIG. 17 is a perspective view illustrating the state of packaging the plasma display panel module in a packaging box in accordance with another exemplary embodiment of the present invention.
Figure 18:
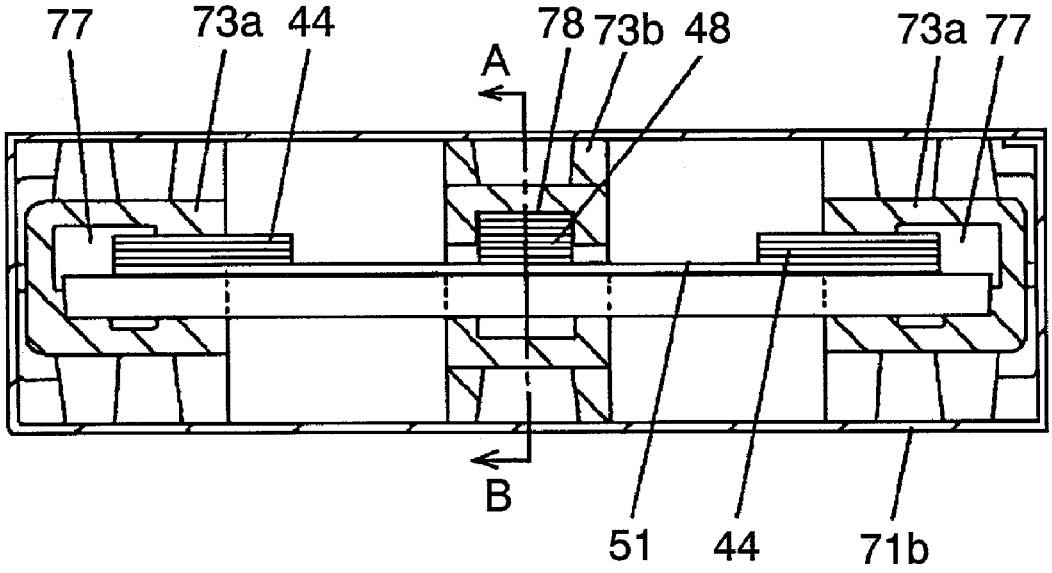
FIG. 18 is a section view illustrating the state when the plasma display panel module is stored in the packaging box.
Figure 19:
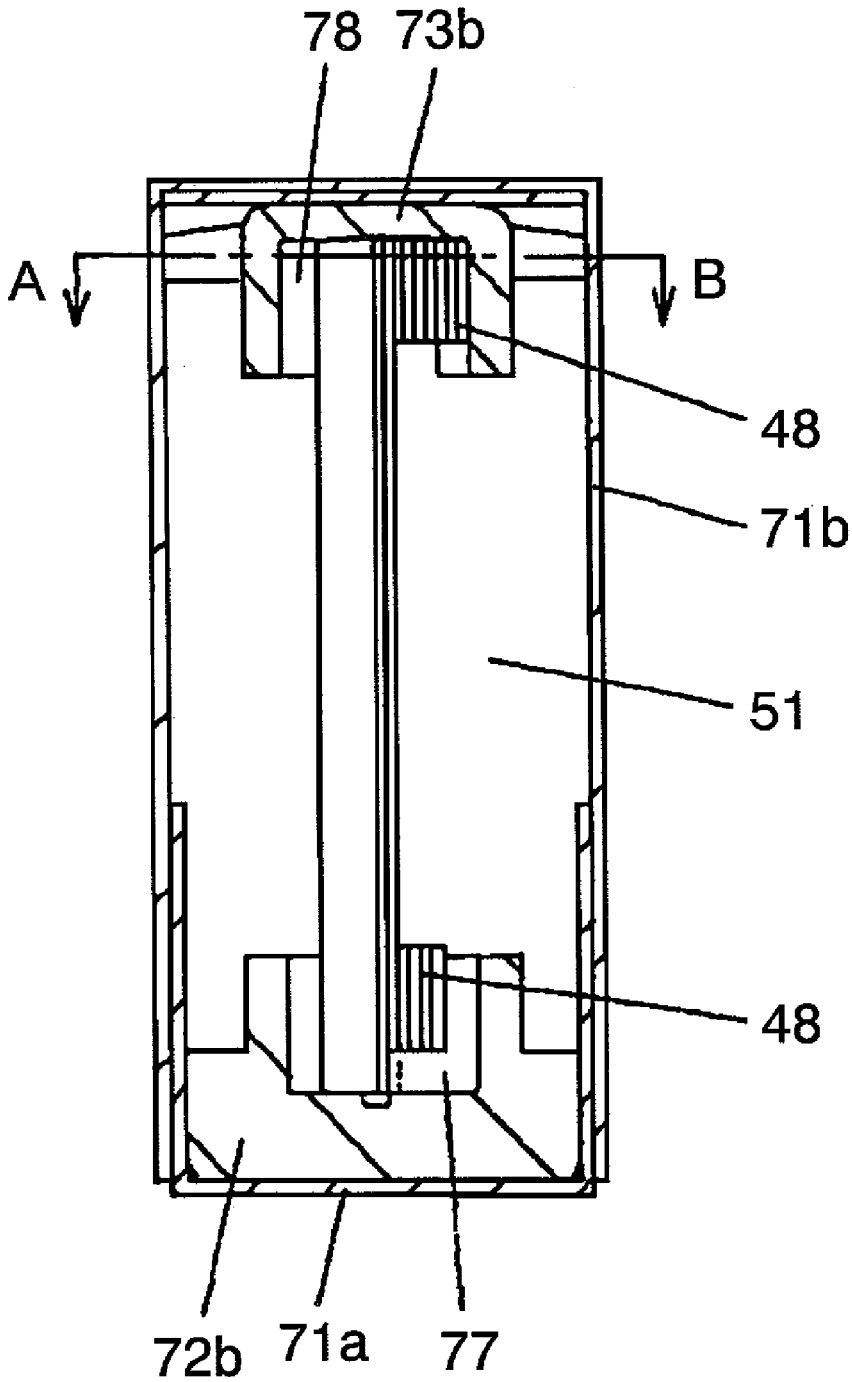
FIG. 19 is a section view illustrating the state when the plasma display panel module is stored in the packaging box.

FIG. 17 shows another exemplary embodiment of storing flat packed module 51 in the packaging box. The packaging box is the same as that for packaging the finished plasma display device. FIGS. 18 and 19 are section views of the packaging box containing packed module 51. FIG. 18 is a section view taken along Line A-B in FIG. 19, and FIG. 19 is a section view taken along Line A-B in FIG. 18.

A rectangular parallelepiped-shaped packaging box is configured with bottom box 71*a* with short height dimension and top box 71*b* with long height dimension. Top box 71*b* covers bottom box 71*a*. Cushioning materials 72*a*, 72*b*, 73*a*, and 73*b* are respectively disposed on the bottom inner face of bottom box 71*a* and the top inner face of top box 71*b*. Packed module 51 covered with sheet 74 is held with these cushioning materials 72*a*, 72*b*, 73*a*, and 73*b*, and stored in the packaging box.

Cushioning material 72*a* is disposed at a corner of bottom box 71*a*, and cushioning material 71*b* is positioned at approximately the center of bottom box 71*a* by fitting protrusion 75 formed on cushioning material 72*b* to hole 76 created on the wall at approximately the center of bottom box 71*a*. Groove 77 is provided on cushioning materials 72*a* and 72*b* for respectively fitting, as shown in FIG. 8, reinforcement 44 and thickened portion 48 on rear protective cover 43. Accordingly, these cushioning materials 72*a* and 72*b* secure the bottom part of packed module 51.

Figure 20:
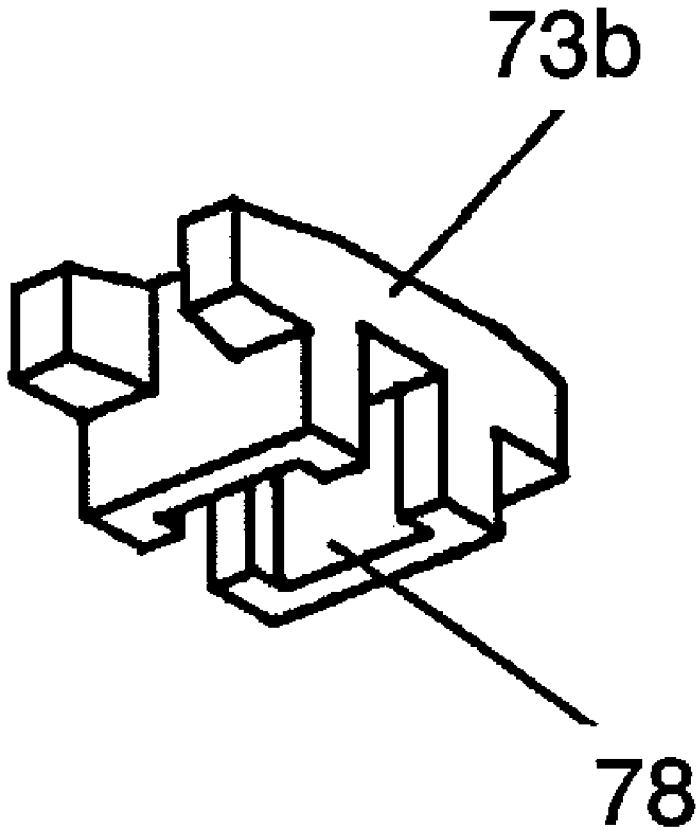
FIG. 20 is a perspective view of an example of a cushioning material in the exemplary embodiment of the present invention.

Cushioning material 73*a* is disposed at a corner of top box 71*b*, and cushioning material 73*b* is disposed at approximately the center of top box 71*b*. As for cushioning materials 72*a* and 72*b*, grooves 77 and 78 are provided on cushioning materials 72*b* and 73*b* for fitting reinforcement 44 and thickened portion 48 on rear protective cover 43. These cushioning materials 73*a* and 73*b* secure the top part of packed module 51. In addition, as shown in FIG. 17, cushioning material 73*b*, disposed approximately at the top center of packed module 51, has a U-shape so that its groove 78 on the inner wall contacts the edge in the width direction of thickened portion 48 on rear protective cover 43. Fitting of this thickened portion 48 in rear protective cover 43 and groove 77 in cushioning material 63*b* positions cushioning material 73*b* at approximately the top center of top box 71*b*. FIG. 20 shows this cushioning material 73*b*.

In the exemplary embodiment of the present invention, thickened portion 48 to which cushioning material 73*b* is fitted is made thicker than reinforcement 44. However, if the entire rear protective cover 43 is made by stacking several corrugated cardboard sheets, there is no need to additionally form reinforcement 44 or thickened portion 48. In this case, thickened portion 48 is made to be thicker than other areas of rear protective cover 43.

As described above, the packaging method in the exemplary embodiments of the present invention employ a packaging box for holding packed module 51 with cushioning materials 72*a*, 72*b*, 73*a*, and 73*b* at least by the corners and approximately the top center and bottom center for storage. Thickened portion 48, which is thicker than the other areas, is provided on rear protective cover 43 at the position corresponding to cushioning material 73*b* which is disposed at approximately the top center of packed module 51. In addition, groove 77 is provided on cushioning material 73*b* for fitting this thickened portion 48. Cushioning material 73*b* is thus positioned by fitting thickened portion 48 on rear protective cover 43 and groove 77 in cushioning material 73*b*. Accordingly, cushioning material 73*b* assures to hold approximately the top center of packed module 51, protecting panel module 40 from impact during transportation.

In particular, panel module 40 with a large screen may significantly deform at the center. The present invention thus demonstrates the further advantageous effects of preventing damage by impact during transportation by securely holding approximately the center of panel module 40.

Next, yet another exemplary embodiment of the present invention is described with reference to FIGS. 21 and 22.

Figure 21:
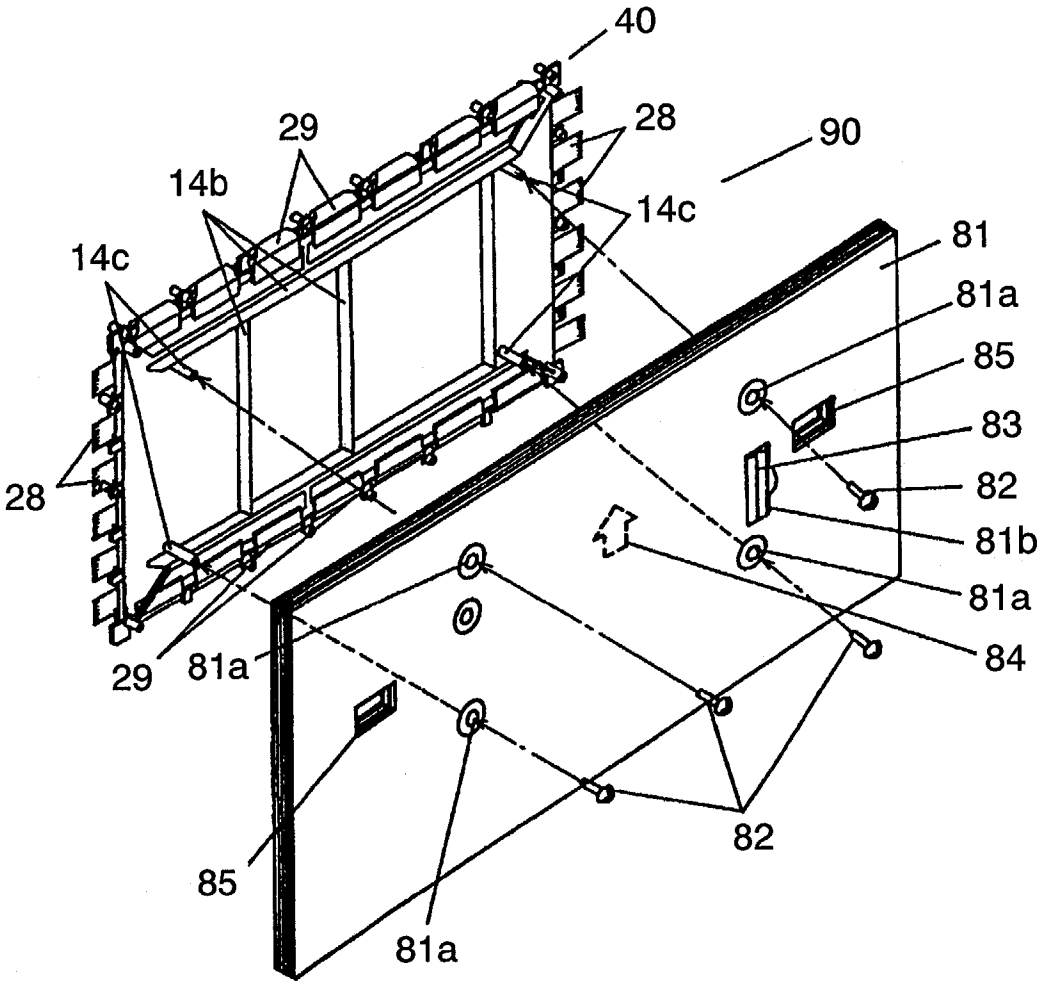
FIG. 21 is a perspective view illustrating a packaging method of the plasma display panel module in yet another exemplary embodiment of the present invention.

As shown in FIG. 21, panel module 40 is configured with aforementioned panel 10, chassis 14 to which panel 10 is attached, and display driving circuit block described with reference to FIG. 5 for displaying information by applying a signal to panel 10 attached to chassis 14. In the exemplary embodiment shown in FIG. 8, a part of address driver circuit block 22 in the display driving circuit block is installed in the panel module. However, how the panel module is assembled depends on the market it is designed for. In other cases, as shown in FIG. 5, all circuit blocks of the display driving circuit may be installed in the panel module. Alternatively, the panel module may only include the scan electrode, sustain electrode, and address electrode of panel 10 connected to flexible wiring boards 28 and 29 of the display driving circuit block by respective electrode leaders. Module holding board 81 is made by stacking several corrugated cardboard sheets, and has a size greater than the outer dimensions of panel module 40.

Module holding board 81 is applied to the rear face of chassis 14 where the display driving circuit block is disposed to cover the rear face of panel module 40. There are four holes 81*a* on module holding board 81. Through these holes 81*a*, screws 82 for fixing metal fittings for securing the plasma display device on the wall are screwed onto four bosses 14*c* integrally provided on chassis 14 for securing the plasma display device on the chassis 14. Notch 81*b* is also provided on module holding board 81, and two stand poles 83 for securing panel module 40 upright, using module holding board 81 as a stand, are stored in this notch 81*b*.

Module holding board 81 also has direction arrow mark 84 at approximately the center to identify the top and bottom of panel module 40. At both ends in the width direction, catch 85 is created by removing a part of module holding board 81 for carrying panel module 40.

Figure 22:
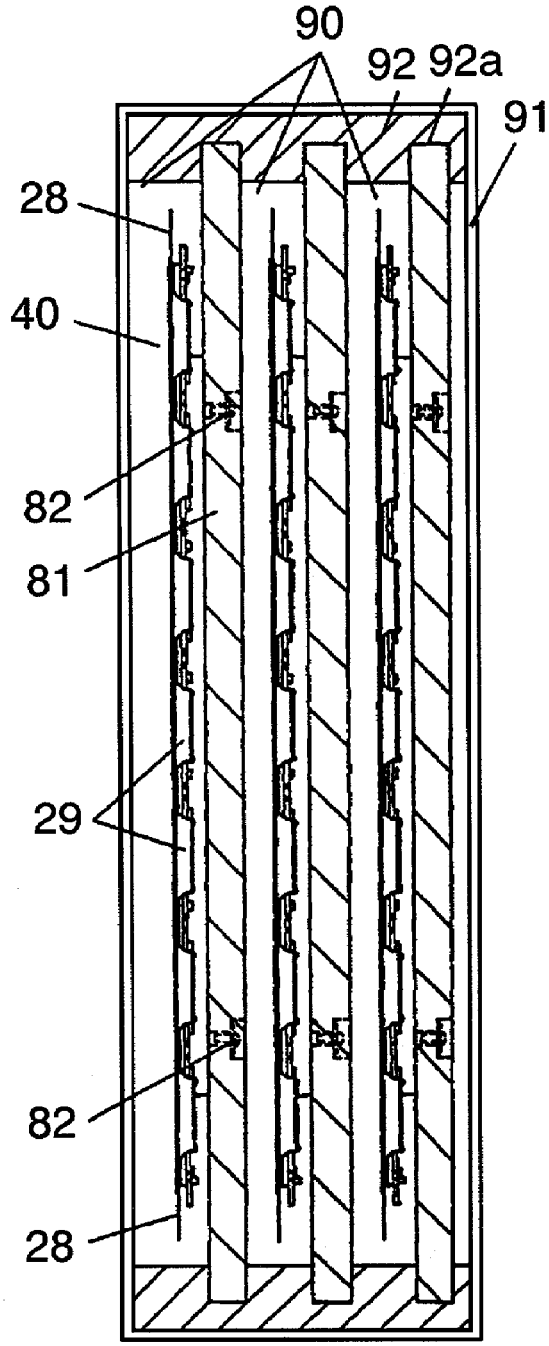
FIG. 22 is a section view when the plasma display panel module is stored in the packaging box in the exemplary embodiment of the present invention.

FIG. 22 is a top view of packed module 90 in the packaging box after attaching module holding board 81 to panel module 40. In FIG. 22, packed module 90 is configured by attaching module holding board 81, made of corrugated cardboard, larger than the outer dimensions of panel module 40 as shown in FIG. 21.

Packed module 90 is held upright in a rectangular parallelepiped-shaped packaging box 91 made of corrugated cardboard by holder 93 having groove 92*a* into which the periphery of module holding board 81 fits, and two or more of these packed module 90 (3 modules in the drawing) are stored in packaging box 91. It is apparent from FIG. 22 that module holding board 81 is sized such that flexible wiring board 28 of panel module 40 does not contact holder 93 when flexible wiring board 28 is stretched straight. In this exemplary embodiment, packaging box 91 is made of corrugated cardboard. However, a reusable resin packaging box may be used to carry items between the panel module manufacturer and the purchaser.

The packaging method in the exemplary embodiment of the present invention uses module holding board 81 made of corrugated cardboard to protect panel module 40. This enables module holding board 81 to be recycled after opening packaging box 91 and removing panel module 40 from module holding board 81, achieving environmentally-friendly packaging.

Moreover, the use of module holding board 81 larger than the outer dimensions of panel module 40 facilitates packing of two or more modules in parallel as shown in FIG. 22.

As described above, the packaging method in this exemplary embodiment of the present invention prevents damage to the panel module resulting from impact during transportation by using a module holding board made of corrugated cardboard. Since the module holding board for protecting the panel module is made of corrugated cardboard, the module holding board is recyclable after opening the packaging box and removing the panel module from the module holding board. Accordingly, the exemplary embodiment also offers packaging that contributes to environmental protection.

Furthermore, the use of a module holding board larger than the outer dimensions of the panel module for protecting the panel module facilitates the packing of two or more modules in parallel in the packaging box.

The packaging method of the present invention applies a resin front protective cover to the periphery of the panel module to prevent damage to the panel module during transportation. In addition, the front protective cover is made of PET resin which is obtainable by recycling PET bottles and containers. It is therefore recyclable as a resource after opening the packaging box and removing the panel module from the front protective cover. Accordingly, the present invention also offers packaging that contributes to environmental protection.

What is claimed is:

1. A packaging method of a plasma display panel module, said panel module comprising:

a panel in which a pair of substrates with at least a front substrate transparent are disposed facing each other to create a discharge space in between, and electrodes are disposed on said substrates;

a chassis holding said panel; and a display driving circuit block attached to said chassis, said display driving circuit block applying a signal to said panel for display; and said method providing a resin front protective cover integrally assembled to a periphery of said panel module to protect the periphery of said panel module, wherein said resin front protective cover has substantially the same dimensions as a front frame of a finished plasma display device.

2. A packaging method of a plasma display panel module, said panel module comprising:

a panel in which a pair of substrates with at least a front substrate transparent are disposed facing each other to create a discharge space in between, and electrodes are disposed on said substrates;

a chassis holding said panel; and a display driving circuit block attached to said chassis, said display driving circuit block applying a signal to said panel for display; and said method providing:

a resin front protective cover integrally assembled to a periphery of said panel module where a flexible wiring board for connecting said panel of said panel module and said display driving circuit block, wherein said front protective cover has substantially the same dimensions as a front frame of the a finished plasma display device; and a cushioning material containing antistatic agent on an inner face of said front protective cover at a position corresponding to said flexible wiring board.

3. The packaging method of a plasma display panel module as defined in one of claims 1 and 2, wherein said front protective cover is made of a polyethylene terephthalate resin.

4. The packaging method of a plasma display panel module as defined in one of claims 1 and 2, wherein a rear face of said panel module is covered with a resin rear protective cover with substantially the same dimensions as a back cover of the finished plasma display device.

5. The packaging method of a plasma display panel module as defined in claim 4, wherein said rear protective cover has substantially the same dimensions as the side face in the width direction of said back cover, and said rear protective cover only covers both side faces in the width direction of said panel module.

6. The packaging method of a plasma display panel module as defined in claim 4, wherein said rear protective cover has substantially the same dimensions as a corner of said back cover, and said rear protective cover only covers a corner of said panel module.

7. The packaging method of a plasma display panel module as defined in claim 4, wherein said rear protective cover is made of polyethylene terephthalate resin.

8. The packaging method of a plasma display panel module as defined in one of claims 1 and 2, wherein a rear face of said panel module is covered with a rear protective cover by attaching said rear protective cover made of corrugated cardboard to the rear face where said display driving circuit block of said chassis is disposed.

9. The packaging method of a plasma display panel module as defined in claim 8, wherein reinforcement made by stacking a plurality of corrugated cardboard sheets is provided on both side faces in the width direction of said rear protective cover, and said rear protective cover is attached by anchoring said chassis onto said reinforcement.

10. The packaging method of a plasma display panel module as defined in claim 9, wherein a catch is provided by cutting a part of said reinforcement provided on both side faces in the width direction of said rear protective cover.

11. The packaging method of a plasma display panel module as defined in claim 8, wherein reinforcement made by stacking a plurality of corrugated cardboard sheets is provided on both side faces in the width direction of said rear protective cover; a thickened portion made by stacking a plurality of corrugated cardboard sheets is provided at approximately the top center and bottom center of said rear protective cover; and said panel module is held with a cushioning material using said reinforcement and said thickened portion for a storage in a packaging box.

12. The packaging method of a plasma display panel module as defined in claim 11, wherein a catch is provided by cutting a part of said reinforcement provided on both side faces in the width direction of said rear protective cover.

13. The packaging method of a plasma display panel module as defined in claim 8, wherein a thickened portion made by stacking corrugated cardboard sheets is provided on approximately the top center and bottom center of said rear protective cover, and said panel module is held with a cushioning material using said thickened portion for a storage in a packaging box.

14. The packaging method of a plasma display panel module as defined in claim 8, wherein a stand pole which can hold said panel module upright is detachably mounted on said rear protective cover, said rear protective cover being used as a stand.

15. The packaging method of a plasma display panel module as defined in one of claims 1 and 2, wherein a module holding board made of corrugated cardboard having the size larger than the outer dimensions of said panel module is applied to the rear face where said display driving circuit block of said chassis is disposed for covering the rear face of said panel module.

16. The packaging method of a plasma display panel module as defined in claim 15, wherein said module holding board is made by stacking a plurality of corrugated cardboard sheets.

17. The packaging method of a plasma display panel module as defined in one of claims 1 and 2, wherein a packed module is formed by attaching a module holding board made of corrugated cardboard having the size larger than the outer dimensions of said panel module, said module holding board being provided at the rear face where said display driving circuit block of said chassis is disposed for covering the rear face of said panel module; and said packed module is held upright in a packaging box by providing a holder, said holder having a groove for fitting a periphery of said module holding board.

18. The packaging method of a plasma display panel module as defined in claim 17, wherein said module holding board is made by stacking a plurality of corrugated cardboard sheets.

19. The packaging method of a plasma display panel module as defined in one of claims 1 and 2, wherein a packed module is formed by attaching a module holding board made of corrugated cardboard having the size larger than the outer dimensions of said panel module, said module holding board being provided at the rear face where said display driving circuit block of said chassis is disposed for covering the rear face of said panel module; and a plurality of said packed modules is held upright in a packaging box by providing a holder, said holder having a groove for fitting a periphery of said module holding board.

20. The packaging method of a plasma display panel module as defined in claim 19, wherein said module holding board is made by stacking a plurality of corrugated cardboard sheets.

21. The packaging method of a plasma display panel module as defined in one of claims 1 and 2, said packaging method employing:

a flat packed module composed by attaching a rear protective cover made of corrugated cardboard to a rear face where said display driving circuit block of said chassis is disposed for covering the rear face of said panel module, and a packaging box for storing said packed module held with a cushioning material at least by its corner, and approximately the top center and bottom center;

wherein said rear protective cover is provided with a thickened portion which is thicker than other areas of said rear protective cover at a position corresponding to the cushioning material disposed at approximately the top center of said packed module, and said cushioning material is provided with a groove for fitting said thickened portion to position said cushioning material by fitting said thickened portion on said rear protective cover into said groove on said cushioning material.

22. The packaging method of a plasma display panel module as defined in claim 21, wherein a reinforcement made by stacking a plurality of corrugated cardboard sheets is provided on said rear protective cover at both sides in the width direction, and said thickened portion made by stacking a plurality of corrugated cardboard sheets is provided at approximately the top center and bottom center of said rear protective cover for holding said panel module with the cushioning material using said reinforcement and said thickened portion for storage in a packaging box.

23. The packaging method of a plasma display panel module as defined in claim 21, wherein said cushioning material for holding approximately the bottom center of said packed module is positioned using a packaging box.

* * * * *